US005138876A

United States Patent [19]

Moore et al.

[11] Patent Number: 5,138,876

[45] Date of Patent: Aug. 18, 1992

[54] METHOD AND APPARATUS FOR MEASURING STEAM PROFILES IN STEAM INJECTION WELLS

[75] Inventors: Boyd B. Moore; Moye Wicks, III, both of Houston, Tex.

[73] Assignee: Shell Oil Company, Houston, Tex.

[21] Appl. No.: 572,734

[22] Filed: Aug. 27, 1990

[51] Int. Cl.[5] ..... E21B 47/00

[52] U.S. Cl. ..... 73/155; 166/250

[58] Field of Search ..... 73/155; 166/172, 173, 166/176, 256, 257, 250

[56] References Cited

U.S. PATENT DOCUMENTS

| | | | |
|---|---|---|---|
| 680,717 | 8/1901 | Labadie | 55/463 |
| 1,311,573 | 7/1919 | Newburgh | 55/463 |
| 2,654,433 | 10/1953 | Piety | 73/155 |
| 2,741,917 | 4/1956 | Piety et al. | 73/155 |
| 2,757,533 | 8/1956 | Wiley | 73/155 |
| 2,868,012 | 1/1959 | Lebourg | 73/155 |
| 3,063,292 | 11/1962 | Glenn, Jr. et al. | 73/155 |
| 3,413,838 | 12/1968 | Duddy | 73/29 |
| 3,905,226 | 9/1975 | Nicolas | 73/155 |
| 3,934,469 | 1/1976 | Howard et al. | 73/155 |
| 3,954,006 | 5/1976 | Anderson et al. | 73/155 |
| 3,982,433 | 9/1976 | Stout | 73/155 |
| 4,088,187 | 5/1978 | Howard et al. | 73/155 X |
| 4,326,411 | 4/1982 | Gant et al. | 73/155 |
| 4,409,825 | 10/1983 | Martin et al. | 73/155 |
| 4,523,479 | 6/1985 | Johnson | 73/861.35 |
| 4,547,078 | 10/1985 | Long et al. | 374/42 |
| 4,581,926 | 4/1986 | Moore et al. | 73/155 |
| 4,736,627 | 4/1988 | Wicks, III et al. | 73/155 |

*Primary Examiner*—Hezron E. Williams
*Assistant Examiner*—George Dombroske

[57] ABSTRACT

A method and apparatus for determining the vapor flow only, or the vapor and liquid flows into various formations surrounding a thermal injection well. The apparatus utilizes a downhole tool having bristles on its outer surface for impeding the flow of fluid past the tool and an instrument at the surface for measuring the drag force produced on the tool as it is moved downward and upward through the well. The fluid flows at various depths in the well are calculated from the measured drag forces.

4 Claims, 2 Drawing Sheets

METHOD AND APPARATUS FOR MEASURING STEAM PROFILES IN STEAM INJECTION WELLS

BACKGROUND OF THE INVENTION

1. Field of the Invention

The present invention relates to the production of liquid hydrocarbons and more particularly to the production of liquid hydrocarbons using various thermal methods. These thermal methods include using steam to heat the formations to reduce the viscosity of the oil so it can be produced. The use of steam to produce heavy crude deposits has increased in recent years as a result of decreasing worldwide reserves and increasing prices.

2. Description of the Prior Art

In a thermal recovery process using steam, two methods are primarily used. In the first, steam is injected into the formation for a period of time after which the well is shut in and allowed to soak. Following the soaking, the crude oil that accumulates in the well is produced and the process is repeated. In the second method, the steam is used not only to heat the formation but also to drive the crude toward a production well. In both of these methods the steam flows through perforations in the well casing into the formation. It is therefore desirable to know the injection profile of the steam entering the formation through the various perforations in the casing. This information is used to design a particular pattern for introducing the steam into the formation to maximize the production and minimize the steam required. It is necessary to know the formation which the steam is entering and also the quantity of steam entering each formation. This information is necessary to determine the amount of heat being applied to each formation that, in combination with the production resulting from the heat input, can be used to calculate the efficiency of the process.

In U.S. Pat. Nos. 4,581,926 and 4,736,627, there is described a method and apparatus for the downhole measurement of the quantity and quality of the steam being injected into the various formations surrounding a thermal injection well. When used in a well having multiple perforated zones, the invention provides a direct means for determining the amount of thermal energy flowing into each zone. The patents describe methods and apparatus for determining not only the amount of steam that is being injected into each zone but also the quantity of liquid present so that the quality of the steam being injected can also be determined.

In order to determine the quantity of liquid being injected the patents disclose various methods for collecting the liquid which flows primarily down the inner wall of the well casing and then measuring the quantity collected. While the apparatus described has been successful in measuring the quantity of liquid, it is complicated and adds to the overall cost and reliability of the measuring instrument.

In addition to the above, the apparatus also includes a motor/generator set and a turbine wheel that is used to monitor or measure the steam vapor flow. The motor/generator is connected to the surface by multiple conductor cables so that the motor can either be powered to run as a motor or a signal can be taken from the unit when it runs as a generator. As described in the patents, this data can then be used to calculate both the steam flow into each formation at any particular depth in the well, as well as the quality of the steam.

While such an instrument has operated satisfactorily it does require considerable equipment and is expensive to build. The complexity of the instrument increases its operating and maintenance costs.

SUMMARY OF THE INVENTION

The present invention provides a method and apparatus for determining the quantity of steam being injected into various formations surrounding a well that is an improvement of the above described instruments. In particular, the present invention utilizes a downhole tool which is passive and does not require any electrical or electronic equipment downhole. Further, the instrument does not require that power be transmitted from the surface to the tool or that electronic signals be transmitted from the tool to the surface. All of the measurements are made at the surface and utilized in a suitable computer to provide information on the steam injection profile of the well.

More particularly, the downhole tool comprises a tool body which is provided with suitable centralizing means to maintain it centered in the well casing. Mounted on the tool body are a series of radially extending flexible bristles similar to those described in the above patent. There are two configurations, "A" and "B," for the metal bristles in the present invention. In configuration "A," the bristles' length is greater than the radial distance between the outer diameter of the tool and the casing, and in "B," the bristles are shorter than this dimension. The "A" configuration is required when it is desired to measure the liquid flow rate and and vapor flow rate; "B" is preferred when only the vapor flow rate is desired.

The bristle arrangement of the "B" configuration of the present invention differs from that described in the above referenced patents in that the overall diameter of the bristle arrangement is slightly less than the inner diameter of the well casing in which the tool is to be run. The tool is designed so that under normal conditions the centralizing means will maintain the tool in the center of the well and the ends of the bristles for the "B" configuration will not contact the surface of the well casing. Since the bristles of the "B" configuration do not touch the casing, the drag on the tool will be produced by the flow of vapor and any entrained droplets of liquid. As described in the referenced patents, the liquid flows predominantly along the casing surface. Thus, the tool for the "B" configuration of this invention will not measure the liquid flow in the well.

The downhole tool of the present invention is coupled to the surface through a solid wire line that is stored on a drum at the surface. The wireline passes over a suitable measuring sheave as it extends down into the well and is used for lowering and raising the tool in the well. In addition, means are provided at the surface for measuring the tension or load on the wireline. The tension on the wireline is directly related to the drag of the tool as it passes through the well.

Also provided at the surface is suitable computer equipment which utilizes the distance measurement of the system and the tension measurement to compute the steam injection profile of the well. The actual calculating steps are more particularly described in the remainder of the application. The calculations from the computer can either be stored in a suitable form or displayed on a visual record which could be inspected at the well site to determine if any remedial action is required.

From the above brief description, it can be seen that the present invention greatly simplifies the downhole tool and eliminates all need for electrical conductors in the cable means that are used for raising or lowering the tool in the well. The tool also makes only one simple tension measurement to collect the data required to make all the calculations related to the steam injection profile.

BRIEF DESCRIPTION OF THE DRAWINGS

The invention will be more easily understood from the following description when taken in conjunction with the attached drawings.

DESCRIPTION OF THE PREFERRED EMBODIMENT

There are two configurations, "A" and "B," for the metal bristles in the present invention. In configuration "A," the bristles' length is greater than the radial distance between the outer diameter of the tool and the casing, and in "B," the bristles are shorter than this dimension. The "A" configuration is required when it is desired to measure the liquid flow rate and vapor flow rate; "B" is preferred when only the vapor flow rate is desired.

CONFIGURATION "A"

Figure 1:
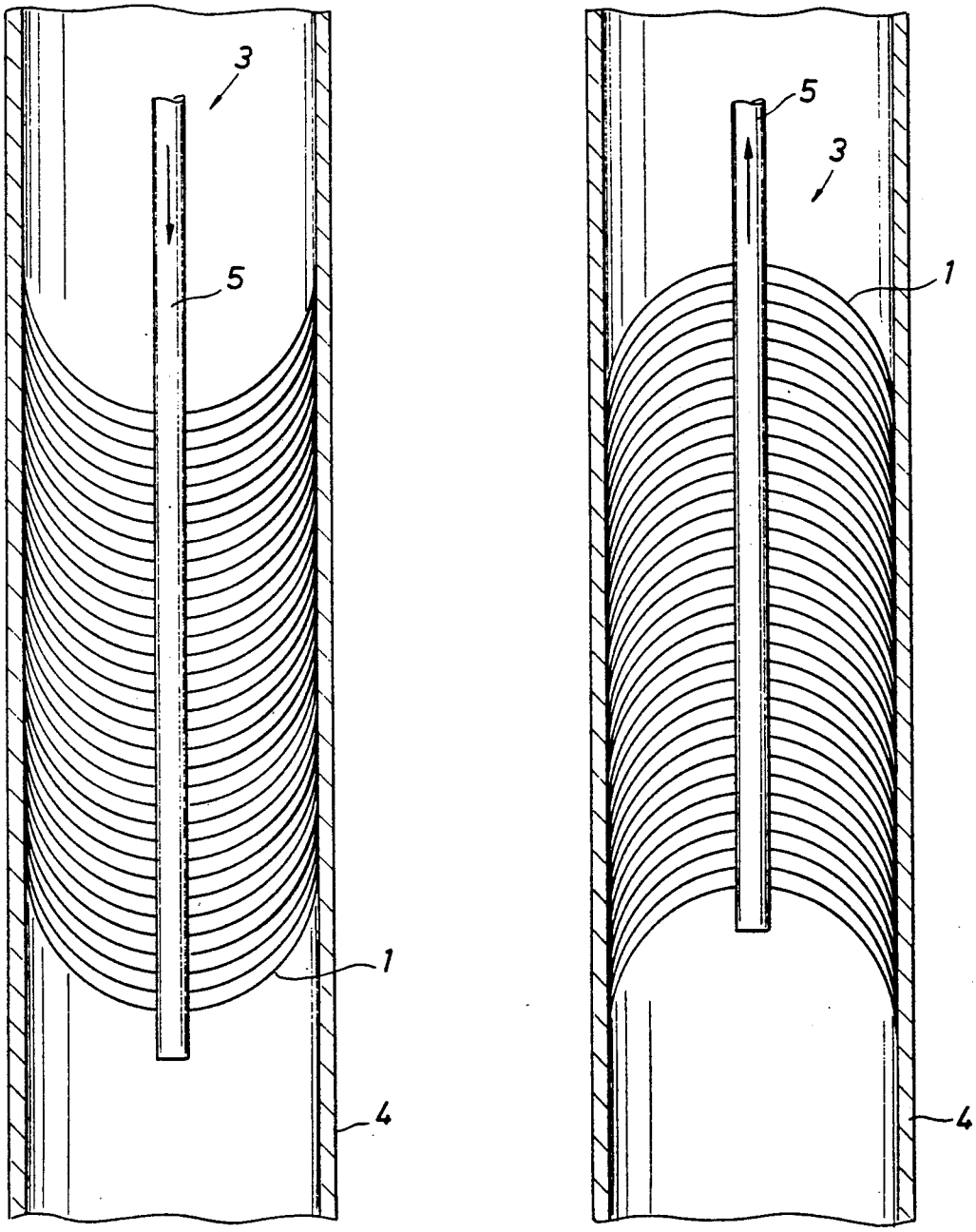
FIG. 1 shows bristles which contact a casing wall in "up" and "down" modes, respectively.

FIG. 1 shows the bristles 1 in the "A" configuration. On the way downhole, the bristles 1 are bent so that their tips point upward. As the tool 3 is raised in the casing 4, the bristles 1 invert so that their tips point downward. Since the bristles 1 contact the wall 4, there is a frictional drag exerted by the wall 4 on the bristles 1, and hence, on the tool body 5. In both dispositions, vapor and liquid flowing through the bristles contribute to measured drag on the tool.

With the bristles 1 "Up," the liquid film flowing along the wall 4 (the only relevant flow regime in the steam injection wells of interest) is scooped away from the wall 4 and flows along the bristles 1 toward the tool body 5. This adds to the drag on the tool 3 an increment over and above that caused by vapor flow through the bristles 1.

With the bristles 1 "Down," liquid flowing at the wall 4 is merely deflected around the bristles 1, requiring less momentum transfer and hence causing less drag than when the bristles 1 point up. Drag on the tool 3, bristles 1 "Up," is thus more sensitive to liquid flow rate than drag on the tool 3, bristles 1 "Down."

Laboratory measurements made over a wide range of conditions give the relations needed to relate drag on the tool 3 to flow rates of gas and liquid, employing relations to scale the measurements from laboratory conditions to those existing in the field. By measuring drag on the tool 3 on the way downhole and on the way uphole, and by subtracting the drag due to wall friction only, i.e., with no flow in the casing, we have for each point desired, two independent relations for the two unknown flow rates (vapor and liquid).

CONFIGURATION "B"

While the "A" configuration gives unique capabilities to measure both liquid and vapor flow rates, the effect of wall friction may affect its inherent accuracy:

- wall friction constitutes a significant fraction of the total measured drag force at low flow rates, requiring the subtraction of a significant part of the total to obtain the flow contribution, and
- liquid draining back into a steam injection well after the well is shut off gives an inherent limitation to how deep the zero flow wall friction can be measured.

Figures 2, 3:
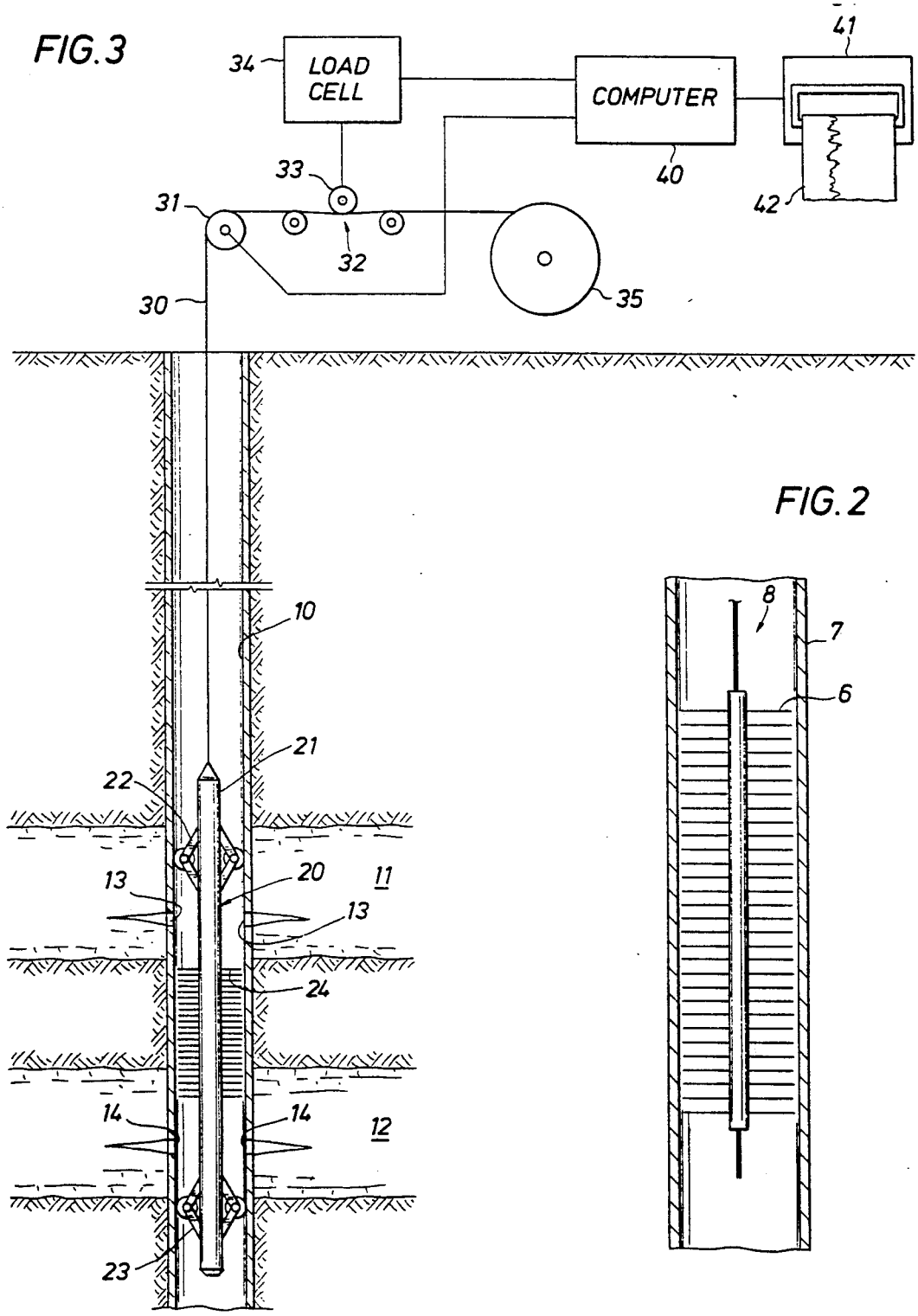
FIG. 2 shows bristles which do not contact a casing wall.
FIG. 3 shows downhole tool and surface equipment according to the present invention.

These factors can be removed by reducing the bristles' 6 length as shown in FIG. 2, so that they do not touch the casing wall 7, but at the cost of also removing any sensitivity to liquid flow rate.

In this condition, drag on the tool 8 is essentially that due to vapor flow only, with no friction at the wall 7 except that caused by the specially designed low-friction ball bearing wheeled centralizers covered in copending patent application T-8309. Since liquid does not contact the bristles 6, the influence of liquid flow rate is that caused by restricting the area available for gas flow. Laboratory tests and calculations using existing published methods show that the liquid film falling down the casing wall 7 is extremely thin, on the order of only 0.10 inch at the highest expected liquid flow rate. Thus, the influence of liquid flow rate on measured drag in Configuration "B" is small.

For the steam profile measurement application at hand, the steam is at 600 psig, and 80% quality. The liquid enthalpy is 9% and the vapor 91% of the total thermal energy injected into the well. Tracer tests in 1988 were performed on a steam injection well in the Kernridge field, using radioactive sodium iodide, which goes into and remains in the liquid phase. A scintillation counter measured the radioactivity present above the first perforation and at the bottom of the vapor zone after passing 14 perforations; 68% of the radioactivity and thus 68% of the liquid was still present, flowing into the liquid level below the vapor zone. Therefore, the liquid contributes only a small amount of the total thermal energy, and most of that goes to the bottom of the well. The vapor distribution is thus by far the more important from the viewpoint of economically apportioning steam energy to the well's various strata.

The present invention is based on the discovery that substantially all of the liquid contained in the steam flows to the bottom of the well. Only a small quantity of the liquid is injected into the formations with the vapor phase of the steam. The liquid accumulates in the bottom of the well until its level reaches the lowest perforations in the well casing. At this point, the liquid will be injected into the formations surrounding the lower portion of the well.

In addition, for average steam conditions in a thermal injection well, i.e., 80 percent quality at 450° F., the vapor carries 91.8 percent of the thermal energy. The measurement of the vapor flow rate alone will provide an accurate thermal injection profile of the well. The total thermal energy contribution of the liquid can be assumed to be injected into the lowest formation in the well. Using these discoveries the construction of the tool is greatly simplified since it is only required to measure the vapor flow.

Referring to FIG. 3, there is shown a well which is cased with a casing 10. The well penetrates two formations 11 and 12 with perforations 13 and 14 being provided in the casing for communication between the well casing and the formations. While the well is shown as penetrating two distinct formations, it could easily be a single formation and there could be multiple perforations in the casing to provide communication with various levels of the formation.

In order to simplify the description, various well and wellhead equipment are not shown in FIG. 3. These include the production tubing and packers that are installed in the well for injecting steam into the well and producing fluids from the well. The wellhead equipment includes the conventional christmas tree and a lubricator for inserting the tool 20 into the well with the well under pressure. These items are all well known to those skilled in the operation of producing wells.

As described above, in the enhanced thermal recovery procedures employing steam as the heating medium, it is desirable to know the injection profile of the steam into the formation. Knowing the injection profile one can calculate the actual heat being supplied to each portion of the formation and then determine the efficiency of the process. In addition, by knowing the injection profile of the steam into the formation it will be easily seen if the steam is short circuiting a portion of the formation and being injected into a single level or portion of the formation. This could occur where a breakthrough between the injection well and the production well occurs and the steam would be effectively short circuiting the formation. It is obvious that this would lead to a very inefficient operation and greatly increase the cost of production.

The downhole tool 20 comprises a central support member 21. The support member is preferably cylindrical in shape and tubular but has sufficient weight so that the tool will easily travel to the bottom of the borehole. The central support member is provided with a centralizing means 22 near its top and a second centralizing means 23 near the bottom. These centralizing means may be similar to those described in copending patent application Ser. No. 516,589 filed Apr. 30, 1990 now U.S. Pat. No. 5,094,103 and assigned to the same assignee as this invention. From the description of the above patent, it can be appreciated that the centralizing members described are positive in their action and not of the bow spring type. Further the centralizing members are provided with rollers which utilize anti-friction bearings to reduce the drag of the instrument as it moves through the well casing. Both of these features are necessary to the present invention since the basic measurement is the drag of the instrument induced by the steam flowing past the bristles described below as the instrument is moved through the borehole. To accomplish this measurement it is necessary to both accurately center the instrument within the well casing and reduce the friction-induced drag of the instrument as it is moved through the well.

The instrument is provided with a plurality of rows of bristles 24 which are similar to those described in the referenced copending application. These bristles are metal fingers which extend radially outward. The overall diameter of the bristles is slightly less than the interior diameter of the casing 10 to ensure that the bristles do not contact the surface of the casing. While any desired number of rows of bristles may be utilized, it is preferable to use at least 30 rows of bristles spaced ⅝-inch apart. This number of bristles has been found to provide excellent results in well casings having a diameter of 6 inches I.D. and a steam flow corresponding to 1,000 barrels per day water feed to the steamer, having 600 psi pressure and 80% quality.

The downhole tool is coupled to a solid wireline cable 30 which is used to raise and lower the tool in the well casing. The single wireline is stored on a reel 35 at the surface. The wireline passes over a conventional distance measuring sheave 31 as it enters the well and through a tension measuring means 32. The tension measuring means is shown as a conventional three-sheave device in which the load on the center sheave 33 is measured by a load cell 34. This is a conventional means for measuring tension on a wireline in which the tendency of the wireline to straighten out between the two sheaves 32 is used as an indication of the tension in the wireline. Of course, other means may be used to measure the tension or load on the wireline. For example, a sheave may be mounted on a mast over the well and the wireline passed over the sheave. A weighing means can be disposed to weigh the load on the sheave as the tool is moved through the borehole.

The signal from the distance measuring sheave 31 and the load cell 34 are supplied to a computer 40 where the actual steam flow into the formation at various levels in the well are computed. The results of the computation can be either stored on a suitable storage means or supplied to a graphical recorder 41 which would print out a continuous record 42. This record could be inspected at the well site to determine if any remedial action is necessary.

The measurement of the tension in the wireline 30 is directly proportional to the total drag force produced by moving the tool through the well. The drag force is produced by the steam flowing past the bristles 24 to enter perforations which are located below the position of the tool in the well. As described in the above, the bristles do not close the complete cross sectional area of the well casing and therefore the steam can flow by a torturous path through the bristles. This tortuous path will produce drag which can be measured and utilized to compute the exact steam flow. The drag force produced by the vapor flow past the tool can be used to determine the quantity of the steam being injected into any particular formation at any depth in the well.

Referring to FIG. 3 there is shown a plot of drag forces on the bristle arrangement produced by various flow rates of gas and water flowing in a conduit. While data shown is representative of the general relationship between drag forces and flow rate, actual data for a specific bristle arrangement can be obtained from laboratory measurements. The measurements can be obtained for various bristle configurations in various size conduits.

In Configuration "A," discussed supra, the drag force produced by liquid flowing alone $(F_D)_L$, the gas flowing alone $(F_D)_G$, and the total drag force with both flowing simultaneously $F_D$ may be measured under various flow conditions and various mixtures of gas and liquid. From these measurements one may compute the drag $(F_D)_M$ due to the mixture of liquid and vapor from the expression:

$$(F_D)_M = F_D - [(F_D)_G + (F_D)_L] \quad (1)$$

One can also develop the following correlations from the data:

$$(F_D)_G = (C_D)_G A_p \frac{\rho_G V_G^2}{2 g_c} \quad (2)$$

$$(F_D)_L = (C_D)_L A_p \frac{\rho_L V_L^2}{2 g_c} \quad (3)$$

$$(F_D)_M = (C_D)_m A_p \frac{\rho_m V_m^2}{2 g_c} \quad (4)$$

where $(C_D)_G$; $(C_D)_L$; $(C_D)_m$ are the drag coefficients for the gas, liquid and mixture, and $$\rho_m = \lambda\rho_L + (1-\lambda)\rho_G$$

$$\lambda = (V_s)_L / [(V_s)_L + (V_s)_G] = (V_s)_L / (V_m)$$

where $V_s$ and $V_G$ are in feet per second.

$A_p$=projected area of all rows of bristles, in square feet.

$$V_m = [(V_s)_L + (V_s)_G]$$

The test data can be analyzed to correlate the $C_D$'s with corresponding Reynolds numbers. The values for the drag coefficients can be used to generalize the drag measurements made in the well.

The drag measurement made in the well will be the drag force ($F_D$) at various depths in the well. Using the drag coefficients obtained for the tool, the vapor superficial velocity ($V_G$) and liquid superficial velocity ($V_L$) at any depth in the well can be computed. From the total mass flow supplied to the well the mass flow injected into the formation at any depth can be computed. This will then supply an injection profile for the well.

While the actual mass flow at any depth can be calculated, the vapor velocities at various depths could be used as an injection profile. Since the mass flow is directly related to velocity, the velocity measurements will provide an injection profile. The mass flows of vapor and liquid can be calculated knowing the vapor and liquid density and flow cross-sectional area:

$$\omega_G = V_G A_F \rho_G$$

$$\omega_L = V_L A_F \rho_L$$

In Configuration "B," discussed supra, the drag force exerted on the tool is determined by the vapor flow rate, only: measured drag is related to vapor rate and density by $$F_D = (F_D)_G = (C_D)_G A_p \frac{\rho_G V_G^2}{2 g_c}$$

where $(C_D)_G$ is the drag coefficient for the vapor. $(C_D)_G$ depends on the vapor Reynolds Number, $(Re)_G$ $$(C_D)_G = f[D_C V_G \rho_G / \mu_G]$$

This functional dependence is found by experimental means, measuring $(F_D)_G$ and calculating $(C_D)_G$ from:

$$(C_D)_G = \frac{(F_D)_G}{A_P \frac{\rho_G V_G^2}{2 g_c}}$$

knowing the other terms in the denominator by measurement ($V_G$) or calculation ($A_P$ and $\rho_G$). Plotting $(C_D)_G$ versus $(Re)_G$ establishes the necessary functional dependence. Having this curve permits determination of ($V_G$) from measurements of $(F_D)_G$. From ($V_G$) the mass flow rate is found:

$$\omega_G = \rho_G V_G A_F$$

What is claimed is:

1. A method for determining the steam injection profile of a thermal injection well, comprising:
   - lowering a tool into the well, said tool including means for impeding the flow of steam through the well;
   - raising the tool in the well;
   - measuring the drag forces on said tool as it is lowered and raised in the well;
   - calculating from said measured drag forces the steam flow velocity at various depths in the well; and
   - calculating the steam injected into various formations using the calculated steam flows.

2. The method of claim 1 in which the tool is first calibrated by running it in a conduit while supplying the conduit with a measured amount of, first, a gas only, and second, a mixture of the gas and a liquid.

3. The method of claim 2 wherein the drag forces are measured separately in each case.

4. The method of claim 3 wherein the separately measured drag forces are used to calculate the coefficients of drag for the dry gas, $(C_D)_G$, gas and liquid mixture, $(C_D)_m$, and liquid $(C_D)_L$.

* * * * *